United States Patent [19]

Tackett et al.

[11] Patent Number: 4,720,274

[45] Date of Patent: Jan. 19, 1988

[54] ELECTRICAL CONNECTOR ASSEMBLY

[75] Inventors: Timothy N. Tackett, Warren; Frederick H. Rider, Youngstown, both of Ohio

[73] Assignee: General Motors Corporation, Detroit, Mich.

[21] Appl. No.: 825,483

[22] Filed: Feb. 3, 1986

[51] Int. Cl.[4] ..... H01R 17/18

[52] U.S. Cl. ..... 439/668; 439/851; 439/862

[58] Field of Search ..... 339/256 R, 258 R, 258 F, 339/258 P, 259 R, 259 F, 252 R, 252 P, 198, 255, 65, 176, 182, 183

[56] References Cited

U.S. PATENT DOCUMENTS

| | | | |
|---|---|---|---|
| 3,199,065 | 8/1965 | Thompson | 339/258 F |
| 3,581,271 | 5/1971 | Knitter et al. | 339/256 R |
| 3,821,693 | 6/1974 | Dechelette | 339/256 R |

FOREIGN PATENT DOCUMENTS

| | | | |
|---|---|---|---|
| 2057313 | 5/1972 | Fed. Rep. of Germany | 339/256 R |
| 2201883 | 7/1973 | Fed. Rep. of Germany | 339/258 R |
| 1304338 | 8/1962 | France | 339/258 F |
| 87500 | 7/1966 | France | 339/256 R |

*Primary Examiner*—Gil Weidenfeld
*Assistant Examiner*—David Pirlot
*Attorney, Agent, or Firm*—Patrick M. Griffin

[57] ABSTRACT

An electrical connector assembly includes a connector body and an electrical terminal and is adapted to receive the cylindrical metal shell of a vehicle cigarette lighter, which makes electrical contact with one side only of the terminal, without applying undesirable forces to the terminal. The connector assembly includes a connector body with a guide means to direct the cigarette lighter shell along a defined path that is substantially parallel to the axis of the shell. A flat wall of the connector body is oriented generally normal to the defined path of the shell. The ground terminal is designed to have a flat compression that does not generate undesired forces to shift it along the connector body wall. The contact portion also includes an integral, stiffening lead-in flange that cooperates in keeping the terminal compression flat.

2 Claims, 4 Drawing Figures

ELECTRICAL CONNECTOR ASSEMBLY

This application relates to electrical connector assemblies in general and specifically to a connector assembly for a vehicle cigarette lighter or the like.

BACKGROUND OF THE INVENTION

A vehicle cigarette lighter or other plug-in ignitor, typically includes a connector body or housing, a component that is physically receivable in the connector body, and an electrical terminal or terminals joined to the connector body for making electrical connection with the component. If the part or surface of the component with which electrical connection is to be made by the terminal has a relatively small width, the electrical connection is simple. For example, the plug-in ignitor shown in the U.S. Pat. No. 4,176,903 to Cairo et al shows a pair of blade-like terminals 21 that simply plug between the legs of a pair of conventional electrical terminals 28 that are themselves fitted within a of pair slots 41 in the connector body. It is a simple matter to space the legs of the terminals less far apart than the width of the blades to closely confine the terminals within the slots, thereby assuring a solid fit and good electrical connection.

Vehicle cigarette lighters typically include a component such as a metal shell, which is often cylindrical. This shell is receivable within a connector body, and an electrical connection with the shell is made by a ground terminal and a feed terminal joined to the connector body. The metal shell generally includes a central coaxial pin extending from the bottom thereof. It is relatively simple to make electrical connection with this pin by plugging it between the legs of a confined feed in the manner described above. However, electrical connection must also be made with the cylindrical outer surface of the lower portion of the shell. Since this surface is too large in diameter to be conveniently plugged between the legs of a terminal, as is the pin, it is more difficult to make electrical connection with it. Electrical connection will thus be most conveniently made by compressing one side only of a terminal against the component surface. This makes it more difficult to solidly anchor and locate the terminal, since it cannot be confined on both sides. If such a terminal is joined to the connector body so that the terminal's length is generally parallel to the path followed by the component as it is plugged into the connector body, then making electrical contact with the surface of the component is relatively easy. For example, the terminal disclosed in the U.S. Pat. No. 3,587,029 to Knowles shows a typical resilient terminal 23 with a bowed or arcuate contact section 25. Contact section 25 may easily make electrical connection with the edge of a circuit board 12, which is moved along a path that is essentially parallel to the length of the terminal 23. The arcuate contact side 25 conveniently serves as a lead-in surface for the edge of the circuit board 12, and is simply compressed as the board 12 moves in.

It may be readily seen that if a cylindrical cigarette lighter shell were substituted for the circuit board 12, electrical contact could still easily be made with a bowed terminal that was similarly oriented. However, it may be desirable, in the interest of saving space, to orient the terminal 90° the other way, normal or perpendicular to the axis of the cigarette lighter shell. In such a case, a conventional bowed or arcuate terminal becomes essentially unusable. For example, referring to the Knowles patent, if the terminal 23 were moved 90° from its existing orientation, the arcuate contact side 25, which had previously served as a lead-in surface, would now actually block the circuit board 12 from moving into the housing, since it would then run into the edge of the terminal, rather than moving along its contact side 25. The problem becomes more difficult if it is necessary to make electrical contact with a cylindrical surface, such as the outer surface of a cigarette lighter shell. Then, the point of contact would have to be made very near the center of curvature of the arcuate side of the terminal in order to avoid applying a force to the terminal that would tend to force it out to either side and out of position.

SUMMARY OF THE INVENTION

The subject invention provides an electrical connector assembly that may be used with a component of the type described above and with a similarly oriented terminal, and which will make electrical contact between the component and one side only of the terminal without applying undesirable forces to the terminal.

The electrical connector assembly of the invention is adapted to make electrical contact with a surface of a component, which is the outer cylindrical surface of the metal shell of a vehicle cigarette lighter, in the embodiment disclosed. The connector assembly of the invention includes a plastic connector body which is itself generally cylindrical and adapted to receive the cigarette lighter shell. The connector body includes a guide means to direct the cigarette lighter shell along a defined path that is substantially parallel to the axis of the shell. The connector body is molded with a substantially flat wall that is generally normal to the defined path of the shell, and spaced from the cylindrical outer surface of the shell.

The assembly also includes an electrical terminal joined to the connector body. The design of the terminal and the manner in which it is joined to the connector body cooperate to make electrical contact with the cylindrical outer surface of the shell, without applying undesirable forces to the terminal that would tend to move it out of position. The electrical terminal is folded from a single piece of metal stock and has a substantially flat base portion with a first flexible leg extending therefrom at an angle. An elongated, substantially flat contact portion extends from the first leg and is spaced from and substantially parallel to the base portion. The contact portion also includes an integral lead-in flange that forms an angle with the contact portion and which extends along a substantial portion of the length of the contact portion. The lead-in flange serves to stiffen the contact portion, as will be further described below. A second flexible leg extends from the contact portion back toward the base portion and terminates at a free end that engages the base portion. The first and second flexible legs are substantially symmetrical, having a similar length, and forming a similar angle with the base portion. The electrical terminal is joined to the connector body with its base portion against the wall of the connector body, and the contact portion of the terminal is thereby oriented generally normal to the defined path followed by the shell as it is received, that is, generally normal to its axis. The electrical terminal is also located in a position such that, as the shell is received in the connector body, the cylindrical surface of the shell will first engage the lead-in flange of the terminal contact portion.

As the shell is pushed along the defined path described above into the connector body, the cylindrical surface of the shell begins to slide down along the lead-in flange and move the contact portion toward the base portion of the terminal, compressing the terminal and forcing the base portion into the wall of the connector body. The cylindrical surface of the shell moves into engagement with the contact portion of the terminal as it reaches its final, seated position in the connector body, making electrical contact therewith. The symmetrical first and second legs are flexed a similar amount, thereby helping to maintain the contact and base portions parallel during the compression. As the compression of the terminal occurs, the lead-in flange also serves to stiffen the contact portion, thereby cooperating with the symmetrically arranged first and second flexible legs to allow the contact portion to move toward the base portion without substantial bending. Therefore, good, consistent electrical contact is made between the terminal contact portion and the cylindrical outer surface of the shell, but substantially no forces are applied to the terminal that would tend to move it out of position in either direction along the wall of the connector body. The invention is useful with a component having a surface of any shape. However, it is particularly advantageous when used with a component, such as the cylindrical cigarette lighter shell, since the contact portion remains tangent to the component's cylindrical surface, and the terminal contact portion may therefore be engaged at a number of positions along its length without applying forces to the terminal that would tend to push it out of position.

It is, therefore, a basic object of the invention to provide an electrical connector assembly of the type that is adapted to receive a component and to make electrical contact with a surface of the component on one side only of an electrical terminal of the assembly, and to make such contact without applying forces to the terminal that would tend to move it out of position relative to the assembly.

It is another object of the invention to provide such a connector assembly that has a connector body adapted to receive the component and direct the component surface along a defined path, a connector body that also has a wall and an electrical terminal joined to the connector, a terminal that has a substantially flat base portion, a first flexible leg extending from the base portion, an elongated, substantially flat contact portion extending from the first leg spaced from and substantially parallel to the base portion and including an integral lead-in flange forming an angle with the contact portion and extending along the length of the contact portion so as to stiffen the contact portion, and a second flexible leg extending from the contact portion toward the base portion and terminating at a free end engaging the base portion, with the first and second legs being substantially symmetrical relative to the base and contact portion, with the base portion of the terminal located against the connector body wall and with the terminal contact portion oriented generally normal to the path of the component contact surface so that, as the component is received in the connector body, the component surface will first engage the contact portion lead-in flange and then engage the contact portion, thereby moving the contact portion toward the base portion as the first and second legs flex and force the base portion into the connector body wall, the lead-in flange, by stiffening the contact portion, cooperating with the symmetrical first and second flexible legs to allow the contact portion to move toward the base portion substantially without bending and substantially parallel to the base portion, so that electrical contact with the component surface can be made without applying forces to the terminal that would tend to move it along the connector body wall and out of position.

It is yet another object of the invention to provide connector assembly with a terminal of the type described in which the component has a substantially cylindrical surface, and in which the connector body is adapted to receive the component and to direct the cylindrical component surface along a path substantially parallel to its axis and in which the connector body wall is oriented generally normal to the path, so that the contact portion of the symmetrical terminal, by moving toward the base portion substantially without bending and substantially parallel to the base portion, will thereby remain tangent to the component surface and make electrical contact therewith without applying forces to the terminal that would tend to move it along the connector body wall and out of position.

BRIEF DESCRIPTION OF THE DRAWINGS

These and other objects and features of the invention will appear from the following written description and drawings in which.

Figure 1:
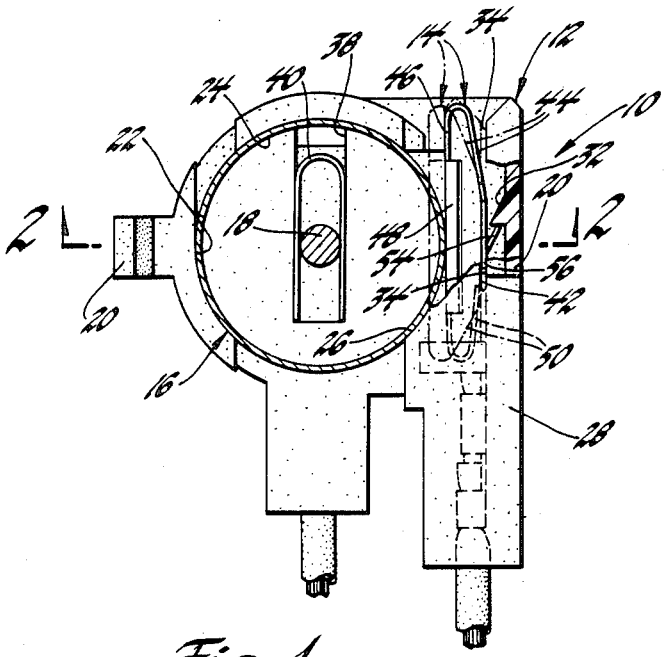
FIG. 1 is a plan view looking into the connector body of the assembly of the invention, with the cigarette lighter shell shown in cross section.

Referring first to FIG. 1, the connector assembly of the invention, designated generally at 10, includes a connector body designated generally at 12 and an electrical ground terminal designated generally at 14. The connector assembly 10 is adapted to receive and to make electrical contact with a component, which, in the embodiment disclosed, is the substantially cylindrical metal shell of a vehicle cigarette lighter, designated generally at 16. Shell 16 has a coaxial central pin 18 extending from the bottom thereof, which may be best seen in FIG. 2.

Figure 2:
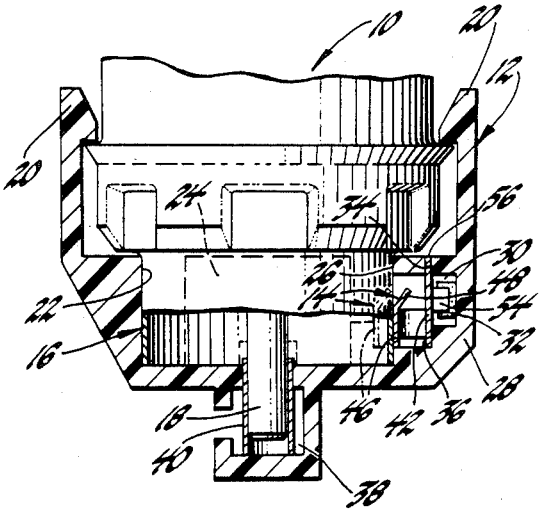
FIG. 2 is a sectional view taken along the line 2—2 of FIG. 1.

Referring now to FIGS. 1 and 2, connector body 12 is molded of plastic or similar material, and has generally the shape of a cylindrical socket. A pair of flexible legs 20 snap fit over the outside of shell 16 to retain it to connector body 12 in conventional fashion. Connector body 12 includes three partially cylindrical guide surfaces 22, 24 and 26. The guide surfaces 22–26, as seen from the perspective of FIG. 1, lie on a common circle that has substantially the same diameter as the cylindrical outer surface of the shell 16. Connector body 12 is thereby adapted to receive the shell 16 and to direct its cylindrical surface along a defined path that is generally parallel to the center axis of shell 16. Other means to so direct the shell 16 could be used, but the one illustrated is convenient and practical.

Still referring to FIGS. 1 and 2, connector body 12 also includes a generally rectangular box 28 molded to one side thereof. For the particular embodiment disclosed, this box 28 includes an inner groove 30 and a ramp 32 located generally centrally in groove 30, the back portion of which is visible in FIG. 2. The top of the box 28 also includes a slot 34 cut partially therethrough, generally parallel to groove 30, which serves a purpose further described below. Groove 30, ramp 32 and slot 34 are not crucial to the invention in the broadest sense. However, as may be seen in FIG. 2, the inwardly facing edge of slot 34 and the bottom shoulder of the parallel groove 30 together lie in a plane and effectively form what may be termed a wall, designated generally at 36. It will be understood that, in an alternate embodiment, wall 36 could be solid or continuous. Wall 36 is generally normal to the central axis of shell 16, that is, generally normal to the defined path that shell 16 follows when it is received in connector body 12, and is spaced from the cylindrical surface of shell 16. This orientation and location is important for reasons described below. As also appears in FIGS. 1 and 2, the center of connector body 12 includes a recess 38 within which a generally U-shaped feed terminal 40 is received. Center pin 18 conventionally plugs into feed terminal 40 to make electrical contact therewith. Terminal 40 is not a part of the invention in the broadest sense, but is necessary to make a complete electrical connection.

Figure 3:
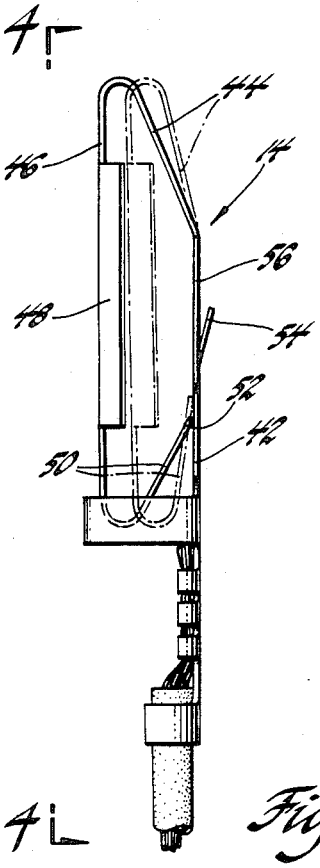
FIG. 3 is a top plan view of the electrical terminal of the assembly.
Figure 4:
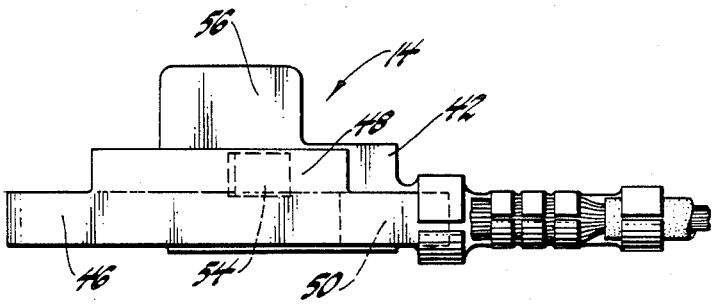
FIG. 4 is a view taken along the line 4—4 of FIG. 3.

Referring next to FIGS. 3 and 4, the details of the ground terminal 14 may be seen, apart from the connector assembly 10. Ground terminal 14 is designed and is joined to the connector body 12 so as to make good, consistent electrical contact with the cylindrical outer surface of the shell 16, without applying undesirable forces that would tend to move ground terminal 14 out of position. Ground terminal 14 is folded from a single piece of metal stock with a substantially flat base portion 42 and a first flexible leg 44 extending outwardly therefrom at an angle. An elongated, substantially flat contact portion 46 extends from the first leg 44 and is spaced from and substantially parallel to the base portion 42. The contact portion 46 also includes an integral lead-in flange 48 that extends upwardly therefrom at an angle and toward base portion 42. Lead-in flange 48 extends along a substantial portion of the length of the contact portion 46, as may be best seen in FIG. 4. The lead-in flange 48 thus serves to stiffen the contact portion 46, as will be further described below. A second flexible leg 50 extends from the contact portion 46 inwardly back toward the base portion 42 and terminates at a free end 52 that engages the inside surface of the base portion 42. The first and second flexible legs 44 and 50 are formed from the same material, of course, and are also of a similar width, length, and make a similar angle with the base portion 42. Consequently, the first and second legs 44 and 50 are substantially symmetrical relative both to the base portion 42 and to the contact portion 46. The ground terminal 14 also includes a resilient tang 54 lanced out of base portion 42 and an upstanding tab 56 integral with base portion 42, best seen in FIG. 4.

Referring now to FIGS. 1 and 2, ground terminal 14 is joined to the connector body 12 by pulling it into box 28. Tab 56 slides into slot 34, and resilient tang 54 slides down groove 30, finally snap fitting over ramp 32. Base portion 42 rests flat against the wall 36, as described above. The contact portion 46 is thereby also oriented generally normal to the defined path followed by shell 16 as it is received, that is, generally normal to its axis. The ground terminal 14 is also located in a position such that, as the shell 16 is pushed into the connector body 12, the cylindrical surface of the shell 16 will first engage the lead-in flange 48, as will be described further below. While the engagement of tang 54 and ramp 32 helps to keep ground terminal 14 stationary and properly seated, it is still desirable that there be some provision made to avoid the application of forces thereto that would tend to shift terminal 14 out of position along wall 36. The invention makes that provision, as will be next described.

Still referring to FIGS. 1 and 2, as the shell 16 is pushed down into the connector body 12, it is guided in the path described above by the guide surfaces 22, 24, and 26. As it moves in that path, the cylindrical surface of the shell 16 begins to slide down along the lead-in flange 48 compressing the ground terminal 14 by moving the contact portion 46 toward the base portion 42. This movement may be seen by comparing the dotted and solid line positions of FIGS. 1 and 2. As it is finally seated, the flexible legs 20 snap over the outside of shell 16, retaining it to connector body 12. Also, the cylindrical surface of shell 16 moves into engagement with the contact portion 46, and central pin 18 plugs into feed terminal 40, making a complete electrical connection. The first and second legs 44 and 50 are flexed, as may be seen in the dotted line position of FIG. 3, and their flexure applies a force that pushes the base portion 42 against the wall 36 of the connector body 12. The symmetry of first and second legs 44 and 50 helps assure that they flex a similar amount as the ground terminal 14 is compressed, and contact portion 46 therefore remains substantially parallel to base portion 42. This flat compression helps assure that no forces are generated with a component along wall 36, as could happen if contact portion 46 tilted relative to base portion 42. Such forces could tend to shift the base portion along wall 36 and out of position. Furthermore, if contact portion 46 were to bend, that could jeopardize the symmetrical and parallel nature of the compression. Consequently, the lead-in flange 48 is designed to stiffen the contact portion 46, in the manner of a corrugation. Even if the contact portion 46 is engaged off center, it remains substantially tangent to the cylindrical outer surface of the shell 16, by virtue of being so stiffened. The motion of the stiffened contact portion 46 therefore remains parallel to base portion 42, and the generation of undesired forces is minimized or prevented. The lead-in flange 48 thereby serves a double function, guiding the shell 16 onto the contact portion 46 as well as cooperating with the symmetrically arranged first and second legs 44 and 50 to give a flat compression. Therefore, good, consistent electrical contact is made between the terminal contact portion 46 and the cylindrical outer surface of the shell 16.

The connector assembly 10 is particularly advantageous when used with a component, such as the cylindrical cigarette lighter shell 16, since the shell 16 makes essentially a line contact with contact portion 46, which is more highly stressed than a flat surface to flat surface contact. However, the invention would be useful with a component having a surface of any shape. Therefore, it will be understood that the invention may be embodied in structures other than that disclosed without departing from the spirit of the invention.

The embodiments of the invention in which an exclusive property or privilege is claimed are defined as follows:

1. An electrical connector assembly including an electrical terminal and adapted to receive a component and to make electrical contact with a surface of said component on one side only of said electrical terminal, said connector assembly comprising in combination, a connector body adapted to receive said component and direct said component surface along a defined path, said connector body also having a wall, said electrical terminal being joined to said connector body, said terminal further having a substantially flat base portion, a first flexible leg extending outwardly from said base portion at a predetermined angle, an elongated, substantially flat contact portion extending from said first leg spaced from and substantially parallel to said base portion and including an integral lead-in flange forming an angle with said contact portion and extending along the length of said contact portion so as to stiffen said contact portion, and a second flexible leg of substantially the same length as said first leg extending from said contact portion inwardly toward said base portion and terminating at a free end engaging said base portion and forming an angle with said base portion substantially equal to said predetermined angle, said first and second legs therefor being substantially symmetrical relative to said base and contact portion, said terminal being joined to said connector body with said base portion against said connector body wall and with said terminal contact portion oriented generally normal to the path of said component contact surface and located such that, as said component is received in said connector body, said component surface first engages said contact portion lead-in flange and then engages said contact portion, thereby moving said contact portion toward said base portion as said first and second legs flex and force said base portion against said connector body wall, said lead-in flange, by stiffening said contact portion, cooperating with said symmetrical first and second flexible legs to allow said contact portion to move toward said base portion substantially without bending and substantially parallel to said base portion, thereby making electrical contact with said component surface without applying forces to said terminal that would tend to move it along said connector body wall and out of position.

2. An electrical connector assembly including an electrical terminal and adapted to receive a component and to make electrical contact with a substantially cylindrical surface of said component on one side only of said electrical terminal, said connector assembly comprising in combination, a connector body adapted to receive said component and direct said component cylindrical surface along a path substantially parallel to the axis of said cylindrical surface, said connector body also having a wall oriented generally normal to said path, said electrical terminal being joined to said connector, said terminal further having a substantially flat base portion, a first flexible leg extending outwardly from said base portion at a predetermined angle, an elongated, substantially flat contact portion extending from said first leg spaced from and substantially parallel to said base portion and including an integral lead-in flange forming an angle with said contact portion and extending along the length of said contact portion so as to stiffen said contact portion, and a second flexible leg of substantially the same length as said first leg extending from said contact portion toward said base portion and terminating at a free end engaging said base portion and forming an angle with said base portion substantially equal to said predetermined angle, said first and second legs therefor being substantially symmetrical relative to said base and contact portion, said terminal being joined to said connector body with said base portion against said connector body wall and with said terminal contact portion thereby being oriented generally normal to the path of said component contact surface and located such that, as said component is received in said connector body, said component surface first engages said contact portion lead-in flange and then engages said contact portion, thereby moving said contact portion toward said base portion as said first and second leg flex and force said base portion against said connector body wall, said lead-in flange, by stiffening said contact portion, cooperating with said symmetrical first and second flexible legs to allow said contact portion to move toward said base portion substantially without bending and substantially parallel to said base portion, thereby remaining tangent to said component surface and making electrical contact therewith without applying forces to said terminal that would tend to move it along said connector body wall and out of position.

* * * * *